US010232616B2

(12) United States Patent
Nakakubo

(10) Patent No.: US 10,232,616 B2
(45) Date of Patent: Mar. 19, 2019

(54) LIQUID EJECTION HEAD

(71) Applicant: CANON KABUSHIKI KAISHA, Tokyo (JP)

(72) Inventor: Toru Nakakubo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/808,140

(22) Filed: Nov. 9, 2017

(65) Prior Publication Data

US 2018/0154635 A1 Jun. 7, 2018

(30) Foreign Application Priority Data

Dec. 6, 2016 (JP) ..... 2016-236613

(51) Int. Cl.
*B41J 2/14* (2006.01)
*B41J 2/16* (2006.01)

(52) U.S. Cl.
CPC ..... *B41J 2/14233* (2013.01); *B41J 2/161* (2013.01); *B41J 2/1623* (2013.01); *B41J 2/1626* (2013.01); *B41J 2/1628* (2013.01); *B41J 2/1629* (2013.01); *B41J 2/1631* (2013.01); *B41J 2/1639* (2013.01); *B41J 2/1642* (2013.01); *B41J 2/1643* (2013.01); *B41J 2/1646* (2013.01)

(58) Field of Classification Search
CPC ..... B41J 2/14233; B41J 2/1646; B41J 2/161; B41J 2/1639; B41J 2/1626; B41J 2/1623; B41J 2/1628; B41J 2/1629; B41J 2/1631; B41J 2/1642; B41J 2/1643
See application file for complete search history.

(56) References Cited

U.S. PATENT DOCUMENTS

| | | | | |
|---|---|---|---|---|
| 8,820,895 | B2 | 9/2014 | Bibl et al. | |
| 9,278,368 | B2 | 3/2016 | Bibl et al. | |
| 9,573,370 | B2 | 2/2017 | Sasagawa et al. | |
| 9,776,408 | B2 | 10/2017 | Bibl et al. | |
| 2006/0027529 | A1* | 2/2006 | Tokunaga | B41J 2/161 216/27 |

FOREIGN PATENT DOCUMENTS

| | | |
|---|---|---|
| JP | 2007-168110 A | 7/2007 |
| JP | 2012-532772 A | 12/2012 |

* cited by examiner

*Primary Examiner* — Juanita D Jackson
(74) *Attorney, Agent, or Firm* — Venable LLP

(57) ABSTRACT

A liquid ejection head includes a substrate, a piezoelectric element above the substrate, an orifice forming member above the substrate on the piezoelectric-element-provided-side, in which the orifice forming member has an ejection orifice for ejecting liquid and defines a pressure chamber between the orifice forming member and the substrate, and the pressure chamber communicates with the ejection orifice and includes the piezoelectric element therein, a first thin film provided between the substrate and piezoelectric element and defining a space between the first film and the substrate, and a second thin film on the piezoelectric element on the side opposite to the first film side and differing from the first film in rigidity. A communicating port is formed in the substrate in a region facing the space, communicates with the space through an opening having a smaller area than the area of the region, and is closed at an end.

9 Claims, 7 Drawing Sheets

LIQUID EJECTION HEAD

BACKGROUND OF THE INVENTION

Field of the Invention

The present invention relates to a liquid ejection head configured to eject a liquid from an ejection orifice by using a piezoelectric element.

Description of the Related Art

Many liquid ejection apparatuses that eject a liquid such as an ink to record images on recording media include liquid ejection heads having a system of generating a pressure in a pressure chamber storing a liquid to eject the liquid from an ejection orifice that is formed on one end of the pressure chamber. As the method of generating a pressure, a method using a piezoelectric element to contract a pressure chamber is known, and as the liquid ejection head using the piezoelectric element, what is called a bend-mode liquid ejection head is known. The bend-mode liquid ejection head has a multilayer structure including a piezoelectric element and a vibrating plate. By applying a voltage, the piezoelectric element is contracted in an in-plane direction, and accordingly the vibrating plate is deformed (bent and deformed) in an out-of-plane direction to generate a pressure in a pressure chamber.

In order to record high-resolution images by using such a liquid ejection head, ejection orifices are required to be arranged at high density. Japanese Patent Application Laid-Open No. 2007-168110 discloses a method for producing a liquid ejection head by highly precise processing using photolithography, enabling arrangement of ejection orifices at high density. Japanese Patent Application Laid-Open No. 2012-532772 discloses a method for producing a liquid ejection head by preparing a substrate with a piezoelectric element and another substrate with wirings for driving the piezoelectric element, enabling arrangement of ejection orifices at high density.

In the production method disclosed in Japanese Patent Application Laid-Open No. 2007-168110, a sacrificial layer is formed on a substrate, then a piezoelectric element and a vibrating plate are formed thereon, and the sacrificial layer is removed by anisotropic etching in order to form a space for displacing the piezoelectric element and the vibrating plate. By the anisotropic etching, the substrate is also etched, and the region of the substrate corresponding to the piezoelectric element is completely removed unfortunately. As a result, wirings cannot be arranged on the region, and thus the increase in arrangement density of ejection orifices is limited to a certain degree. In the production method disclosed in Japanese Patent Application Laid-Open No. 2012-532772, physical connection by an adhesive and electric connection and physical connection by a gold bump are simultaneously performed to stack and join two substrates, thus the joining conditions are strict, and the production yield may be reduced.

SUMMARY OF THE INVENTION

The present disclosure is intended to provide a highly reliable liquid ejection head enabling arrangement of ejection orifices at high density and a method for producing the liquid ejection head.

In order to achieve the object, a liquid ejection head of the present invention includes a substrate, a piezoelectric element provided above the substrate, an ejection orifice forming member provided above the substrate on a side on which the piezoelectric element is provided, the ejection orifice forming member having an ejection orifice configured to eject a liquid and defining a pressure chamber between the ejection orifice forming member and the substrate, the pressure chamber communicating with the ejection orifice and including the piezoelectric element therein, a first thin film provided between the substrate and the piezoelectric element and defining a space between the first thin film and the substrate, and a second thin film provided on the piezoelectric element on a side opposite to the first thin film side and differing from the first thin film in rigidity. In an aspect, a communicating port is formed in the substrate in a region facing the space, communicates with the space through an opening having a smaller area than an area of the region, and is closed at an end. In another aspect, a communicating port is formed in the first thin film in a region facing the space, communicates with the space through an opening having a smaller area than an area of the region, and is closed in an inside or at an end.

A method for producing a liquid ejection head of the present invention includes a step of forming a sacrificial layer on a substrate, a step of forming a first thin film on the sacrificial layer, a step of forming a piezoelectric element on the first thin film, a step of forming a second thin film on the piezoelectric element, the second thin film differing from the first thin film in rigidity, a step of providing, above the substrate on a side on which the piezoelectric element is provided, an ejection orifice forming member having an ejection orifice configured to eject a liquid, thereby forming a pressure chamber between the ejection orifice forming member and the substrate, the pressure chamber communicating with the ejection orifice and including the piezoelectric element therein, and a step of removing the sacrificial layer to form a space between the substrate and the first thin film. In an aspect, the step of forming a space includes a step of forming a communicating port in the substrate, the communicating port communicating with the sacrificial layer through an opening having a smaller area than an area of a region of the sacrificial layer, the region facing the substrate, a step of removing the sacrificial layer through the communicating port, and a step of closing an end of the communicating port. In another aspect, the step of forming a space includes a step of forming a communicating port in the first thin film, the communicating port communicating with the sacrificial layer through an opening having a smaller area than an area of a region of the sacrificial layer, the region facing the first thin film, a step of removing the sacrificial layer through the communicating port, and a step of closing an inside or an end of the communicating port.

In such a liquid ejection head and a method for producing a liquid ejection head, a region of the substrate corresponding to the piezoelectric element can be efficiently used as a space for arranging wirings and integrated circuits, and ejection orifices can be arranged at high density. In addition, joining steps including joining between substrates are not necessarily performed in strict conditions, and thus a reduction of production yield can be suppressed.

Further features of the present invention will become apparent from the following description of exemplary embodiments with reference to the attached drawings.

DESCRIPTION OF THE EMBODIMENTS

Embodiments of the present invention will now be described with reference to the accompanying drawings.

First Embodiment

Figure 1A:
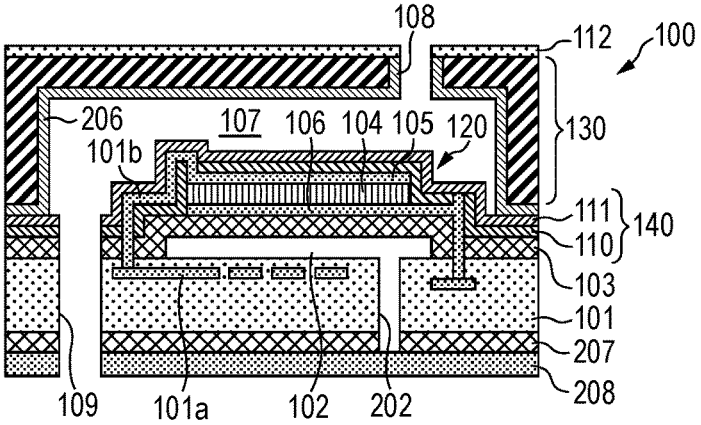
FIGS. 1A and 1B are schematic cross-sectional views of liquid ejection heads pertaining to a first embodiment.
Figure 1B:
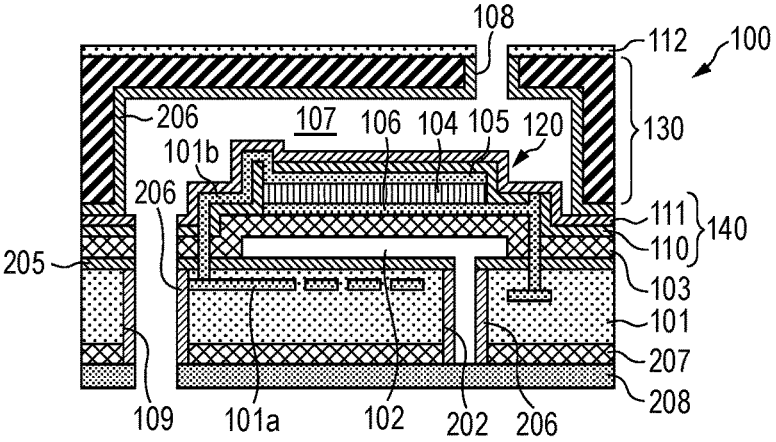
Figure 2:
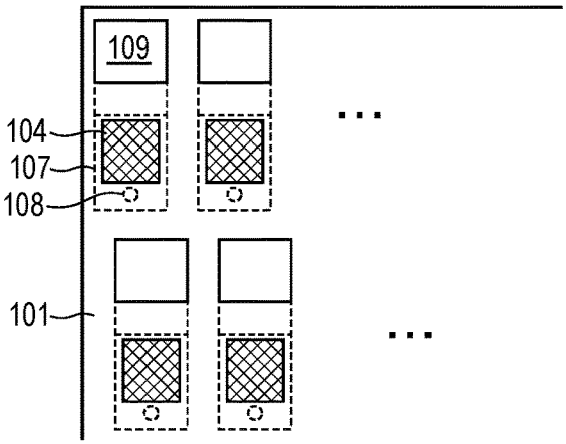
FIG. 2 is a schematic plan view of a liquid ejection head pertaining to the first embodiment.
Figure 3A:
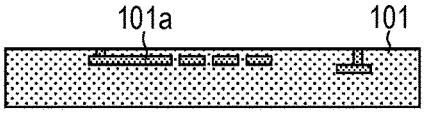
FIGS. 3A, 3B, 3C, 3D, 3E, 3F, 3G, 3H, 3I, 3J, 3K and 3L are schematic cross-sectional views showing a method for producing a liquid ejection head pertaining to the first embodiment.
Figure 3B:
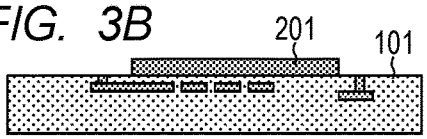
Figure 3C:
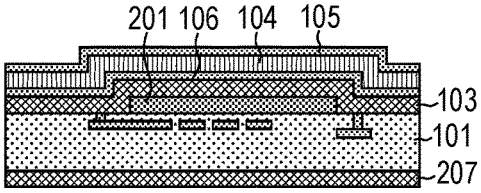
Figure 3D:
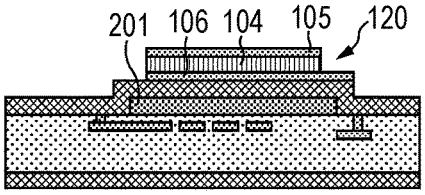
Figure 3E:
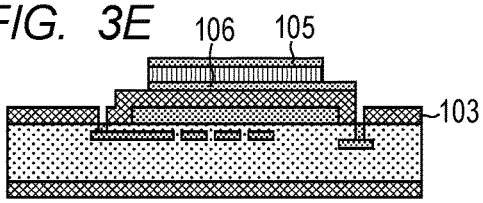
Figure 3F:
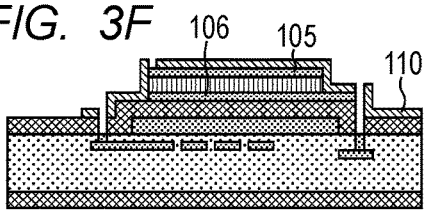
Figure 3G:
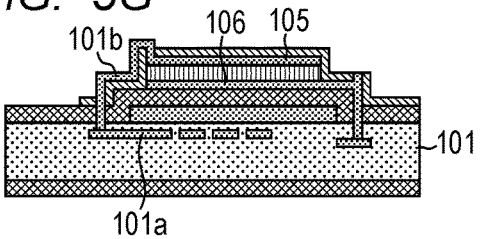
Figure 3H:
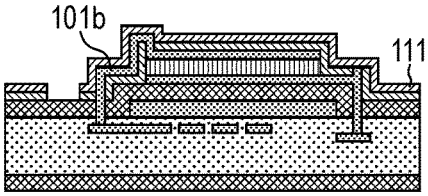
Figure 3I:
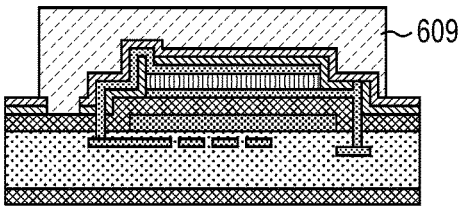
Figure 3J:
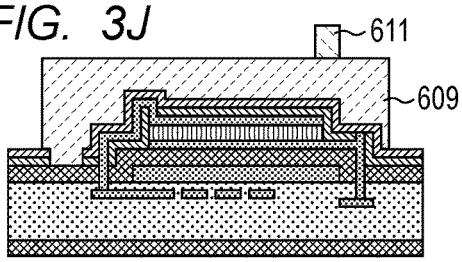
Figure 3K:
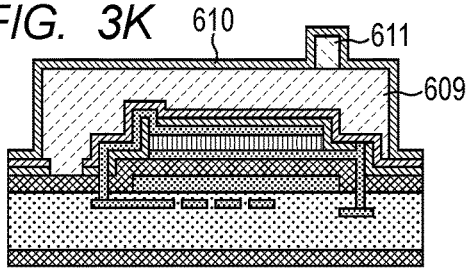
Figure 3L:
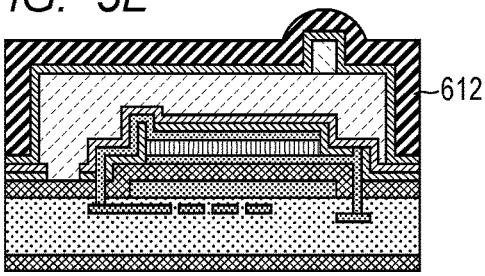
Figure 4A:
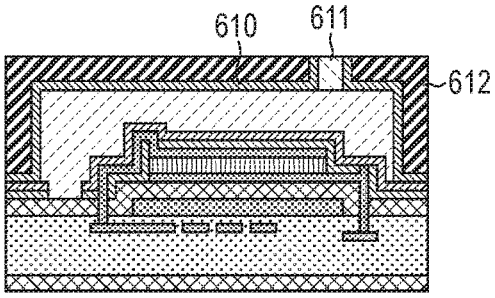
FIGS. 4A, 4B, 4C, 4D, 4E and 4F are schematic cross-sectional views showing the method for producing a liquid ejection head pertaining to the first embodiment.
Figure 4B:
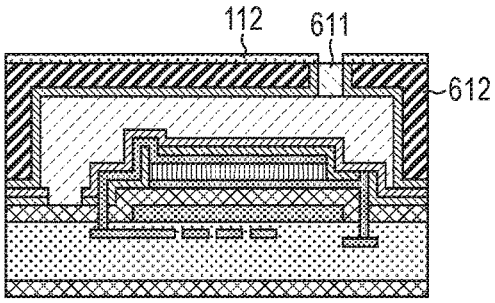
Figure 4C:
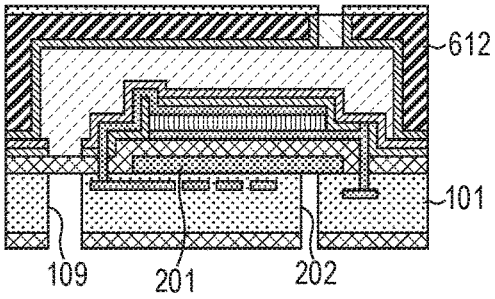
Figure 4D:
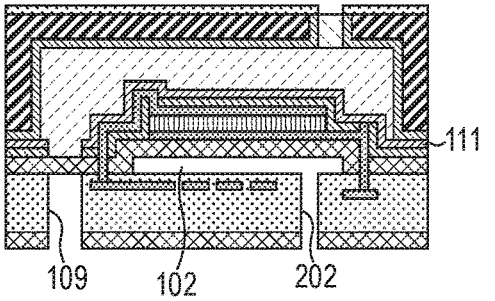
Figure 4E:
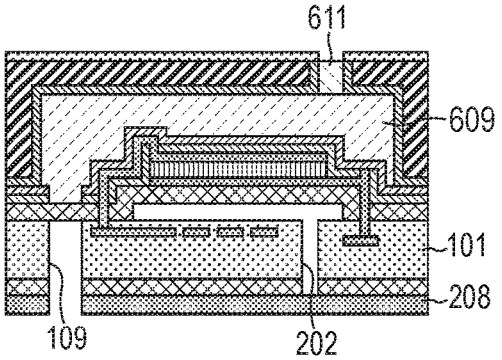
Figure 4F:
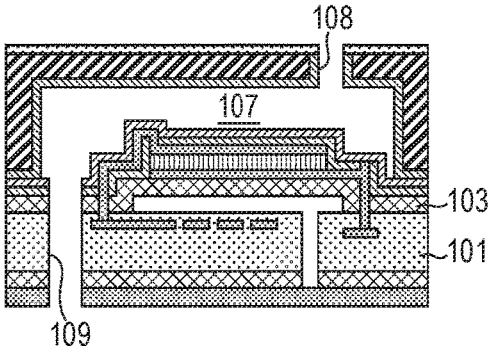

With reference to FIGS. 1A, 1B and 2, the structure of a liquid ejection head pertaining to a first embodiment of the present disclosure will be described. FIG. 1A is a schematic cross-sectional view showing a liquid ejection head of the embodiment, and FIG. 1B is a schematic cross-sectional view showing a modified liquid ejection head of the embodiment. FIG. 2 is a schematic plan view of the liquid ejection head of the embodiment.

With reference to FIG. 1A, a liquid ejection head 100 includes a substrate 101, a piezoelectric element 120, an ejection orifice forming member 130, a first thin film 103, and a second thin film 140. The piezoelectric element 120 is provided above the substrate 101 and includes a piezoelectric body 104, an upper electrode 105, and a lower electrode 106. The lower electrode 106, the piezoelectric body 104, and the upper electrode 105 are stacked in this order in the thickness direction of the substrate 101. The ejection orifice forming member 130 is provided above the substrate 101 on the side on which the piezoelectric element 120 is provided, has an ejection orifice 108 for ejecting a liquid such as an ink, and defines, between the ejection orifice forming member and the substrate 101, a pressure chamber 107 that communicates with the ejection orifice 108 and has the piezoelectric element 120 therein. In the substrate 101, a supply port 109 communicating with the pressure chamber 107 and for supplying a liquid to the pressure chamber 107 is formed through the substrate 101.

The first thin film 103 is provided between the substrate 101 and the piezoelectric element 120 and defines a space 102 between the first thin film and the substrate 101. As described later specifically, the first thin film 103 functions as a vibrating plate for generating a pressure in the pressure chamber 107, and the space 102 is provided in order to displace the first thin film 103 as the vibrating plate. In other words, when the piezoelectric element 120 is driven to displace the first thin film 103 as the vibrating plate, and a pressure is accordingly generated in the pressure chamber 107, a liquid in the pressure chamber 107 can be ejected from the ejection orifice 108. In order to record high-definition images, it is preferred to independently control liquid ejection operation for each ejection orifice 108. A common first thin film 103 as the vibrating plate may be provided for a plurality of pressure chambers 107, but independent first thin films 103 are preferably provided for corresponding pressure chambers 107 for the above purpose. The second thin film 140 includes two protective films 110, 111 and functions as a protective film for the piezoelectric element 120.

In the substrate 101, a communicating port 202 communicating with the space 102 is formed through the substrate 101 in addition to the supply port 109. The communicating port 202 communicates with the space 102 through an opening having a smaller area than the area of the bottom face of the space 102 (the region of the substrate 101 facing the space 102) and is used as an etching hole in an etching process for forming the space 102 as described later. Above the substrate 101 on the side opposite to the side on which the piezoelectric element 120 is provided, a closing layer 208 that closes an end of the communicating port 202 is provided, and can prevent the space 102 from communicating with the supply port 109 as a flow path of a liquid or with the pressure chamber 107. Between the substrate 101 and the first thin film 103, or between the substrate 101 and the space 102, a substrate protective film (third thin film) 205 for protecting the substrate 101 in the etching process may be provided as shown in FIG. 1B. Similarly, on the inner walls of the supply port 109 and the communicating port 202, an inner wall protective film (fourth thin film) 206 for protecting the supply port 109 and the communicating port 202 from an etchant may be provided as shown in FIG. 1B.

In FIG. 2, pressure chambers 107 are arranged in a matrix state, and accordingly, ejection orifices 108 are also arranged in a matrix state to form a plurality of ejection orifice arrays. Here, in an example case in which ejection orifices 108 are arranged at a pitch of 150 dpi (about 169 μm) in an ejection orifice array, and the adjacent ejection orifice arrays are displaced by 1,200 dpi (about 21 μm) in the arranging direction of the ejection orifices 108, the horizontal size of each element will be described.

If a pressure chamber 107 has a horizontal size of 120 μm×210 μm, the wall distance between two adjacent pressure chambers 107 is about 49 μm in each ejection orifice array. Here, the displacement region of the piezoelectric element 120 determined by the space 102 is slightly smaller than the horizontal size of the pressure chamber 107 and can be 115 μm×200 μm. The amount of volume change (volume change per unit voltage) of the pressure chamber 107 by the piezoelectric element 120 having the displacement region with such a size is about 0.26 pL/V. Hence, if the drive voltage is 25 V, the volume change is about 6.5 pL, and about 4 pL of a liquid can be ejected. The horizontal size of the supply port 109 is about 120 μm×80 μm in consideration of suppressing the crosstalk and having a sufficient performance for liquid recharge. If the distance between the adjacent ejection orifice arrays is 350 μm, the wall distance therebetween is 30 μm.

With reference to FIGS. 3A to 4F, a method for producing a liquid ejection head of the embodiment will next be described. FIGS. 3A to 4F are schematic cross-sectional views of a liquid ejection head in respective steps of the production method of the embodiment. The following steps (3*a*) to (3*l*) correspond to FIG. 3A to FIG. 3L, and the steps (4*a*) to (4*f*) correspond to FIG. 4A to FIG. 4F.

(3*a*) As the substrate 101, a substrate made from silicon (Si) is prepared. On the substrate 101, a wiring layer 101*a* is previously formed. The wiring material of the wiring layer 101*a* can be aluminum (Al), a compound thereof, or tungsten (W), for example. Use of Al can reduce the electrical resistance of a wiring, but when a high temperature process is performed after wiring formation, W is preferably used. A part of the surface of the wiring layer 101*a* can be exposed for subsequent electrical connection of a lead-out wiring to an upper electrode 105 or a lower electrode 106, and the other part can be protected by SiN, $SiO_2$, or the like. The wiring layer 101*a* may include an integrated circuit such as a complementary metal oxide semiconductor (CMOS) in order to reduce the number of wirings. The function of the CMOS is exemplified by a function of constituting a switch for ON/OFF of an ejection signal in response to image data.

(3*b*) On the substrate 101, a sacrificial layer 201 is formed by photolithography. The sacrificial layer 201 is removed in a subsequent etching process, and thus the material thereof is preferably a material having high etching selectivity to a peripheral member and having high etching rate. The combination of such a sacrificial layer 201, a peripheral member, and an etchant is exemplified by the following combinations. For example, a first combination is a combination of Al as the sacrificial layer 201, Si as the peripheral member, and an Al wet etchant as the etchant. A second combination is a combination of $SiO_2$ as the sacrificial layer 201, Si as the peripheral member, and HF as the etchant. In particular, when gas phase HF is used as the etchant, even a thin sacrificial layer 201 can be efficiently etched. However, when $SiO_2$ is used as the sacrificial layer 201 and $SiO_2$ is also used as other members, the surface of the other members is required to be previously protected. A third combination is a combination of Si as the sacrificial layer 201, $SiO_2$ as the peripheral member, and $XeF_2$ as the etchant (dry etching). In this case, a substrate protective film 205 is required to be formed on the substrate 101 before the formation of the sacrificial layer 201 in order to protect the substrate 101 made from Si as shown in FIG. 1B. In addition to the above combinations, any other combination can be used as long as the etching selectivity can be achieved.

When the displacement amount of the piezoelectric element 120 is several hundreds of nanometers, the sacrificial layer 201 preferably has a thickness of 500 nm or more to 1,500 nm or less. This is because a thicker sacrificial layer 201 makes a larger level difference in a cross-sectional shape of the piezoelectric element 120. The horizontal size of the sacrificial layer 201 is appropriately designed according to the ejection amount or ejection frequency of a liquid and the layout of the ejection orifice 108. For example, when about 4 pL of a liquid drop is ejected at about 100 kHz, the horizontal size of the sacrificial layer 201 is set at about 115 μm×200 μm for ejection orifices 108 arranged at a pitch of 150 dpi as in the embodiment and is set at about 80 μm×500 μm for a pitch of 200 dpi.

(3*c*) On the substrate 101 and the sacrificial layer 201, a first thin film 103 functioning as a vibrating plate is formed. As the first thin film 103, a SiN film having a thickness of about 500 to 2,000 nm can be formed, for example. The film formation method can be a plasma enhanced chemical vapor deposition (PE-CVD) method or a low pressure chemical vapor deposition (LP-CVD) method, for example. When the LP-CVD method is used, a low-stress, high-density film more suitable as a vibrating plate can be prepared, but for a substrate 101 including an integrated circuit, the PE-CVD method is preferably used in order to reduce the film formation temperature. As the first thin film 103, $SiO_2$ can also be used, and the film formation method therefor is preferably the PE-CVD method. In addition to the above, Si can also be used as the first thin film 103. The first thin film 103 is not necessarily a single film and may be a multilayer film composed of a plurality of materials. For example, SiN can be used as the first layer, and $SiO_2$ can be used as the second layer. Such a film can be selected according to internal stress, adhesion, and etching selection ratio to another process, for example. In addition to the first thin film 103, a substrate protective film 207 made from the same material as the first thin film 103 is formed, on the face opposite to the face on which the first thin film 103 is formed. On the first thin film 103, a lower electrode 106, a piezoelectric body 104, and an upper electrode 105 are further formed as films in this order. As the lower electrode 106, a Pt film having a thickness of about 50 to 150 nm can be formed by sputtering, for example. In order to improve the adhesion of the lower electrode 106, an adhesion layer having a thickness of about 1 to 50 nm and made from Ti, $TiO_2$, ZrO, SrO, LNO, or the like may be provided between the lower electrode 106 and the first thin film 103. The piezoelectric body 104 can be lead zirconate titanate (PZT) or a substance prepared by doping PZT with niobium (Nb), for example. The film formation method is typically a sol-gel method. Especially for a substrate 101 including an integrated circuit, film formation at about 500° C. or less and annealing are required, and the film formation temperature is required to be reduced. In this case, low-temperature sputtering, a pulsed laser deposition (PLD) method, or a transfer method is appropriately used, for example. In particular, sputtering achieves high crystallizability, can give a piezoelectric body suitable for a liquid ejection head having high dielectric strength, and thus is preferred. The appropriate thickness of the piezoelectric body 104 is 500 to 3,000 nm. In order to improve the crystalline orientation control or adhesion of the piezoelectric body 104, an adhesion layer having a thickness of about 1 to 5 nm and made from Ti, $TiO_2$, ZrO, SrO, LNO, or the like may be provided between the piezoelectric body 104 and the lower electrode 106. As the upper electrode 105, a film of Pt, IrO, RuO, TiW, or the like having a thickness of about 50 to 150 nm can be formed, for example. The film formation method therefor is preferably sputtering. In order to improve the adhesion of the upper electrode 105, an adhesion layer having a thickness of about 1 to 5 nm and made from Ti, $TiO_2$, ZrO, SrO, LNO, or the like may be provided between the upper electrode 105 and the piezoelectric body 104.

(3*d*) The upper electrode 105, the piezoelectric body 104, and the lower electrode 106 are patterned by photolithography to form a piezoelectric element 120. The etching may be either wet etching or dry etching, and the dry etching is preferably used because the dry etching gives less damage on the piezoelectric body 104 and can reduce side etching. For the etching of the piezoelectric body 104, a patterned upper electrode 105 can be used as a hard mask. By reducing the short side width of the piezoelectric body 104 by about 2 to 6 μm from the short side width of the sacrificial layer 201 at the time of patterning, the displacement efficiency of the piezoelectric element 120 can be further improved.

(3*e*) The first thin film 103 is patterned by photolithography to form through-holes for lead-out wirings from the upper electrode 105 and the lower electrode 106. The patterning can be performed by dry etching.

(3*f*) A first protective film 110 is formed as a first layer of a second thin film 140 and is patterned to form through-holes for lead-out wirings. The first protective film 110 is required to be formed from an insulating material in order to insulate the lead-out wiring from the upper electrode 105, from the lower electrode 106. Such a first protective film 110 is, for example, a $SiO_2$ film formed by a tetraethoxysilane (TEOS)-CVD method capable of forming a film at low temperature. The first protective film 110 preferably has a thickness of 100 to 300 nm. The patterning is preferably performed by dry etching.

(3*g*) Films of Al, an Al compound, or the like having a thickness of about 500 to 1,000 nm are formed by, for example, sputtering and are patterned to form lead-out wirings 101*b* for connecting the upper electrode 105 and the lower electrode 106 to the wiring layer 101*a* on the substrate 101. The patterning can be performed by dry etching or wet etching.

(3*h*) As a second layer of the second thin film 140, a second protective film 111 is formed to protect the lead-out wirings 101*b*, and is patterned to form a through-hole communicating with a supply port 109 subsequently formed. The patterning is performed by dry etching. The second protective film 111 is required to be formed from an insulating material in order to insulate the wirings 101*b* from a liquid such as an ink. The second protective film 111 is also required to have resistance to a liquid. Such a second protective film 111 is a $SiO_2$ film formed by a TEOS-CVD method capable of forming a film at low temperature, a SiN film by a PE-CVD method, or an oxide film by an atomic layer deposition (ALD) method, for example. The second protective film 111 preferably has a thickness of 100 to 300 nm. When the ALD method is used, a conformal film is formed, and thus the thickness may be about several nanometers.

(3*i*) A first mold material 609 that is removed in a subsequent step to form a pressure chamber 107 is formed. The formation method can be a printing technique or a photolithography technique, and a photolithography technique using a photosensitive resin is preferred in terms of being capable of forming fine patterns. The material of the first mold material 609 is preferably a material that can be patterned even with a large film thickness and can be removed by an alkaline solution or an organic solvent in a subsequent step. Such a material can be THB series (trade name) manufactured by JSR and PMER series (trade name) manufactured by Tokyo Ohka Kogyo Co., Ltd., for example. Alternatively, a photosensitive dry film processed in a film shape can be laminated in order to form the first mold material 609. When a dry film is used, the mold material can have a larger thickness, accordingly the pressure chamber 107 can have a lower flow path resistance to be speedily recharged with a liquid, and the ejection frequency can be increased. The first mold material 609 preferably has a thickness of 20 to 60 μm.

(3*j*) On the first mold material 609, a second mold material 611 that is removed in a subsequent step to form an ejection orifice 108 is formed. The material of the second mold material 611 can be THB series (trade name) manufactured by JSR and PMER series (trade name) manufactured by Tokyo Ohka Kogyo Co., Ltd., for example. The material of the second mold material 611 is not limited to them and can be a material that can be patterned even with a large film thickness and can be removed by an alkaline solution or an organic solvent in a subsequent step.

(3*k*) On the first mold material 609 and the second mold material 611, a conductive layer 610 made from Pt, Au, Cu, Ni, Ti, or the like is formed by sputtering, for example. The conductive layer 610 preferably has a thickness of 50 nm or more.

(3*l*) A coating layer 612 to be an ejection orifice forming member 130 is formed by plating. The plating type includes electroplating and electroless plating and can be appropriately selected and used. Here, electroplating is used to form a coating layer 612 from Ni. The electroplating is advantageous in terms of an inexpensive treatment liquid and easy waste liquid treatment, whereas the electroless plating is advantageous in terms of good adhesiveness, capable of forming a uniform film, and hardness and abrasion resistance of a plating film. The coating layer 612 preferably has a thickness of about 10 to 30 μm.

(4*a*) The surface of the coating layer 612 is polished and planarized. Specifically, the coating layer 612 and the conductive layer 610 are removed by polishing until the second mold material 611 is exposed.

(4*b*) On the coating layer 612, a thin Ni-polytetrafluoroethylene (PTFE) composite plating layer is formed by electroplating as a water repellent film 112. By this plating, no Ni-PTFE layer is formed on an exposed second mold material 611, which has no conductive layer 610.

(4*c*) In order to protect the substrate 101 on the side on which the coating layer 612 is formed, from an etchant, a tape removable in a subsequent step is attached to the face at the side, or the face is bonded to a support substrate. Next, deep reactive ion etching (D-RIE) is performed from the opposite side of the face to form a supply port 109 and an etching hole (communicating port) 202 in the substrate 101. Here, the etching hole 202 is formed through the substrate 101 so as to communicate with one end of the sacrificial layer 201 through an opening having a smaller area than the area of the bottom face of the sacrificial layer 201 (the region facing the substrate 101). With this structure, a large part of the region of the substrate 101 facing the sacrificial layer 201 can be efficiently used as a space for arranging wirings and integrated circuits, and ejection orifices 108 can be arranged at high density. The supply port 109 preferably has an opening size of about 60 to 120 μm (80 μm×120 μm for an ejection orifice 108 in an array shown in FIG. 2), and the etching hole 202 preferably has an opening size of about 10 to 100 μm.

(4*d*) The sacrificial layer 201 is removed by etching to form a space 102. A specific etching method is appropriately selected according to the material of the sacrificial layer 201 as described above. When Si is used for a sacrificial layer 201, a protective film 206 made from $SiO_2$ or the like is formed on the inner walls of the supply port 109 and the etching hole 202 as shown in FIG. 1B before etching in order to protect the substrate 101 from an etchant. As the film formation method, a TEOS-CVD method capable of forming a film at low temperature is suitable, and after the film formation, dry etching with a bias voltage is performed to selectively remove the $SiO_2$ film formed on the bottom of the etching hole 202. When $SiO_2$ is used for a sacrificial layer 201, the second protective film 111 is required to be formed from a material except $SiO_2$, for example, from SiN, or the supply port 109 is required to be temporarily sealed before etching.

(4*e*) The etching hole 202 is sealed (closed). The sealing method is exemplified by a method of providing a closing layer 208 for closing the etching hole 202, above the substrate 101 on the side with an opening of the etching hole 202. Specifically, in a first method, a plurality of micropores with a size of 1 μm or less are previously formed as the etching hole 202, and a layer 208 made from $SiO_2$, SiN, or the like is formed above the substrate 101 on the side with openings of the etching holes 202 to close the micropores. In a second method, another substrate 208 having only an opening corresponding to the supply port 109 is bonded to close the etching hole 202.

(4*f*) Dry etching is performed from the side of the substrate 101 with the opening of the supply port 109, and a part of the first thin film 103 facing the supply port 109 is removed. In addition, the first mold material 609 and the second mold material 611 are removed by an alkaline solution or an organic solvent to form a pressure chamber 107 and an ejection orifice 108. Consequently, the liquid ejection head 100 shown in FIG. 1A is completed.

In the present embodiment, a vibrating plate (first thin film) 103 is formed on a sacrificial layer 201, and then the sacrificial layer 201 is removed to form a space 102, but the method of forming a space 102 is not limited to this process. For example, a structure member excluding a part to be a space 102 can be formed on a substrate 101, and a vibrating plate 103 is bonded thereon to form the space 102. The bonding in the case is preferably performed in a vacuum in order to suppress deformation due to expansion of the air in the space 102 in a subsequent heating process. However, the method of forming a vibrating plate 103 on a sacrificial layer 201 described in the present embodiment is suitable because a thin vibrating plate 103 can be formed and a smaller pressure chamber 107 can be formed.

With reference to FIG. 1A, the rigidity and the displacement of the piezoelectric element 120 in the embodiment will be described. When a voltage is applied across the upper electrode 105 and the lower electrode 106, the piezoelectric body 104 is about to expand in a direction parallel to the applied electric field and is about to contract in a direction perpendicular to the applied electric field. However, one face of the piezoelectric body 104 is restricted by the lower electrode 106 and the first thin film 103, and the other face is restricted by the upper electrode 105 and the second thin film 140. In addition, the lateral faces are restricted by the second thin film 140. The movement of the piezoelectric body 104 is limited by a balance between these restrictions and the contractive force of the piezoelectric body 104, and thus the first thin film 103, the piezoelectric element 120, and the second thin film 140 bend to cause a volume change in the pressure chamber 107 required for ejecting a liquid.

In the present embodiment, by increasing the rigidity of the first thin film 103 as compared with the second thin film 140, the first thin film 103 is allowed to function as a vibrating plate, and the pressure chamber 107 can be displaced so as to expand at the time of voltage application. When the first thin film 103 has a higher rigidity, the second thin film 140 having a lower rigidity is in contact with the lateral faces of the piezoelectric body 104. Consequently, the restriction of the piezoelectric body 104 is reduced at the lateral face sides and at the side facing the pressure chamber 107, thus the displacement efficiency of the piezoelectric element 120 can be increased, and the first thin film 103 as the vibrating plate can be largely displaced.

By increasing the rigidity of the second thin film 140 as compared with the rigidity of the first thin film 103, the second thin film 140 is also allowed to function as a vibrating plate. However, when a second thin film 140 has a higher rigidity, the second thin film 140, which is in contact with the lateral faces of the piezoelectric body 104, restricts the displacement of the piezoelectric element 120, and the displacement efficiency of the piezoelectric element 120 may be reduced. For these reasons, the first thin film 103 preferably has a higher rigidity than that of the second thin film 140 so as to function as the vibrating plate as in the embodiment.

The method of increasing the rigidity of a first thin film 103 is exemplified by a method of forming a first thin film 103 from a material having a higher Young's modulus and a method of forming a first thin film 103 with a higher film thickness. In order to reduce the rigidity of a second thin film 140, the opposite methods can be performed. The material having a higher Young's modulus is exemplified by SiN, and the material having a lower Young's modulus is exemplified by $SiO_2$. For example, when a piezoelectric body 104 has a thickness of 2 μm, a first thin film 103 made from SiN has a thickness of 800 nm, and a second thin film 140 has the following structure, the first thin film 103 can have a higher rigidity than that of the second thin film 140. In other words, when the second thin film 140 includes a first layer 110 formed from $SiO_2$ and having a thickness of 300 nm and a second layer 111 having a thickness of 200 nm, the first thin film 103 can have a higher rigidity than that of the second thin film 140. With such a structure, about 30 times larger displacement can be achieved than in the case when the rigidity of the first thin film 103 is lower than the rigidity of the second thin film 140. The first thin film 103 can have a two-layer structure. In such a case, the first layer can be formed from SiN to have a thickness of 600 nm, and the second layer can be formed from $SiO_2$ to have a thickness of 400 nm, for example. The rigidities of the upper electrode 105 and the lower electrode 106 also affect the displacement of the vibrating plate, but the rigidity of a flat plate is generally proportional to the cube of the thickness, and thus the effect is small. In other words, the thicknesses of the electrodes 105, 106, 50 to 150 nm, are sufficiently small as compared with the thickness of the first thin film 103, 800 to 1,000 nm, and thus the effect of the rigidities of the upper electrode 105 and the lower electrode 106 on the displacement of the vibrating plate is small.

Second Embodiment

Figure 5:
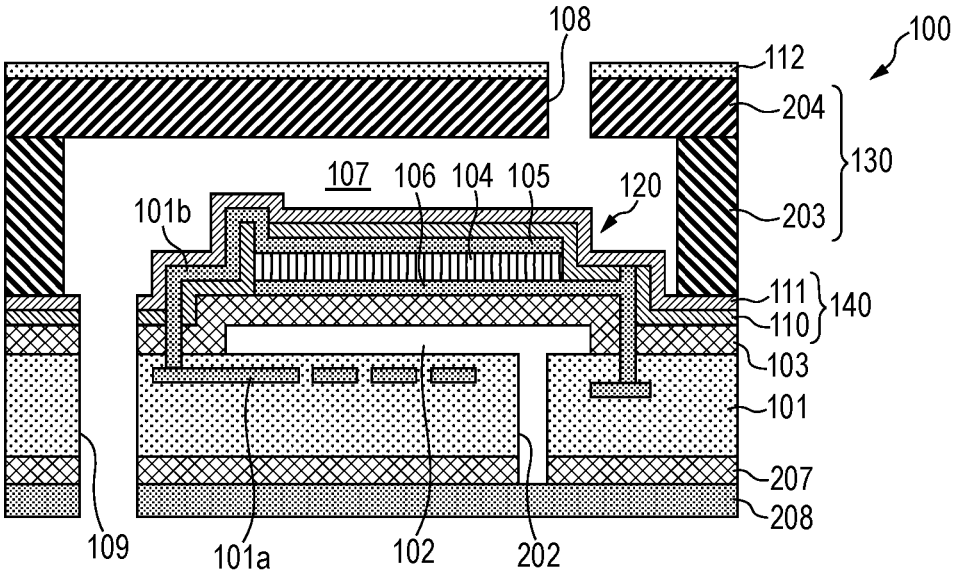
FIG. 5 is a schematic cross-sectional view of a liquid ejection head pertaining to a second embodiment.
Figure 6A:
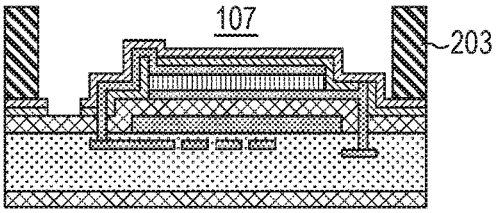
FIGS. 6A, 6B, 6C, 6D, 6E, 6F and 6G are schematic cross-sectional views showing a method for producing a liquid ejection head pertaining to the second embodiment.
Figure 6B:
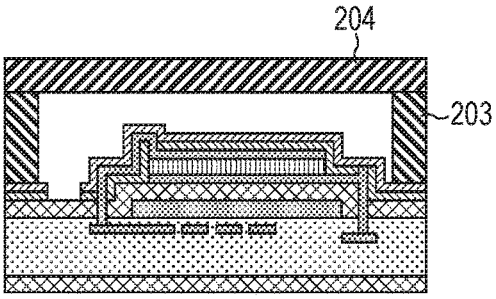
Figure 6C:
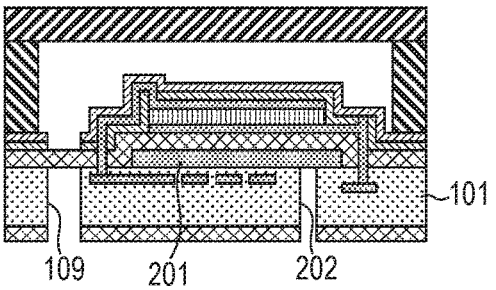
Figure 6D:
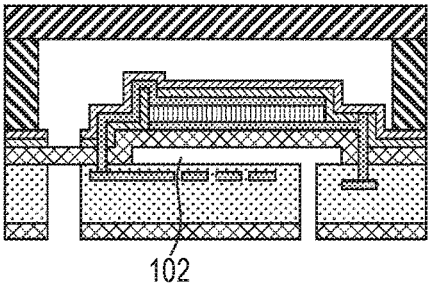
Figure 6E:
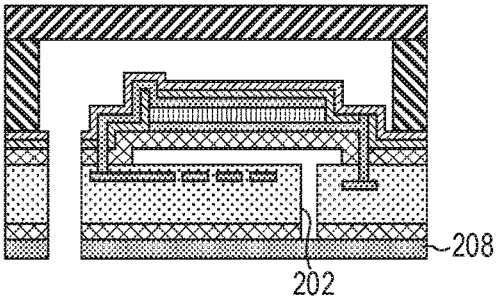
Figure 6F:
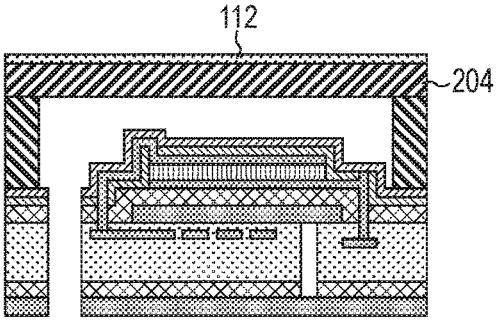
Figure 6G:
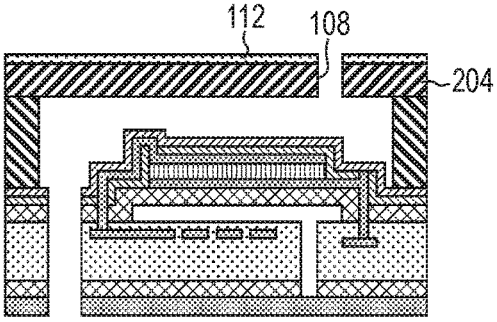

FIG. 5 is a schematic cross-sectional view showing a structure example of a liquid ejection head pertaining to a second embodiment in the present disclosure. The present embodiment differs from the first embodiment in structure of the ejection orifice forming member 130. Specifically, the ejection orifice forming member 130 is composed of two members 203, 204 unlike the first embodiment. One is a first member 203 having a pressure chamber 107 and made from a resin material, and the other is a second member 204 having an ejection orifice 108 and made from an inorganic material. The other structure except the above is the same as in the first embodiment.

With reference to FIGS. 6A to 6G, a method for producing a liquid ejection head of the embodiment will next be described. FIGS. 6A to 6G are schematic cross-sectional views of a liquid ejection head in respective steps of the production method of the embodiment. The following steps (6*a*) to (6*g*) correspond to FIG. 6A to FIG. 6G. In the production method of the embodiment, steps before step (6*a*) are the same as step (3*a*) to step (3*h*) in the first embodiment and are not described.

(6*a*) A photosensitive dry film is laminated and patterned to form a first member 203 having a pressure chamber 107. The first member 203 preferably has a thickness of 20 to 60 μm.

(6*b*) To the first member 203, a second member 204 made from Si is bonded, and is polished to an intended thickness. The appropriate thickness of the second member 204 is about 10 to 30 μm, which depends on the diameter of an ejection orifice 108 to be subsequently formed. The method of bonding the first member 203 and the second member 204 can be a method of bonding them with an adhesive or a method of hardening the first member 203 made from a dry film by pressure or heat to bond them.

(6*c*) The same procedure as in step (4*c*) of the first embodiment is performed in the same conditions, forming a supply port 109 and an etching hole (communicating port) 202 in the substrate 101.

(6*d*) The same procedure as in step (4*d*) of the first embodiment is performed in the same conditions, removing the sacrificial layer 201 to form a space 102.

(6*e*) The same procedure as in step (4*e*) of the first embodiment is performed in the same conditions, sealing (closing) the etching hole 202 by a closing layer 208.

After this step or after step (6*a*), a step of forming a protective film for protecting each member from a liquid such as an ink may be performed. The protective film in this case is suitably a $SiO_2$ film by a TEOS-CVD method or a TaO film by an ALD method, for example.

(6*f*) On the second member 204, a water repellent film 112 is formed. The material of the water repellent film 112 can be a fluorine coupling agent or a silane coupling agent, and the film formation method can be a deposition method, for example.

(6*g*) In the second member 204, an ejection orifice 108 is formed by photolithography and D-RIE. Consequently, the liquid ejection head 100 shown in FIG. 5 is completed.

When a photoresist is intended to be applied onto the water repellent film 112, the water repellent film 112 repels the photoresist. Thus, a laminate of a photosensitive dry film is preferably used as the mask for the photolithography. Alternatively, a water repellent protective film such as a Ti film may be deposited on the water repellent film 112 to make the surface of the water repellent film 112 non-water repellent, then a photoresist may be applied onto the surface, and photolithography may be performed. Next, the resist may be removed, and then the water repellent protective film may be removed.

According to the present embodiment, the effect shown below can be achieved in addition to the effect achieved in the first embodiment. In other words, the side wall height of the pressure chamber 107 can be comparatively reduced to 20 to 60 μm, and the wall distance between adjacent pressure chambers 107 can be 30 μm or more. Accordingly, crosstalk or consumption of ejection energy due to wall deformation can be sufficiently suppressed even when a photosensitive dry film as an organic resin having a low Young's modulus is used as the first member 203. In addition, Si having a high Young's modulus is used as the second member 204, thus the wall of the first member 203 is prevented from falling, and consumption of ejection energy due to deformation of a face of the second member 204 with an opening of the ejection orifice 108 can be sufficiently suppressed.

According to the production method of the present embodiment, both the first member 203 made from a photosensitive dry film and the second member 204 made from Si are bonded to the substrate 101, and then a photosensitive resin for forming the ejection orifice 108 is exposed, developed, and patterned. Thus, the alignment accuracy of the first member 203 and the second member 204 at the time of bonding of them does not affect the location accuracy of each member of the liquid ejection head 100, and a liquid ejection head 100 can be produced with high precision. Hence, the ejection variation can be suppressed, and ejection orifices 108 can be arranged at higher density.

Third Embodiment

Figure 7A:
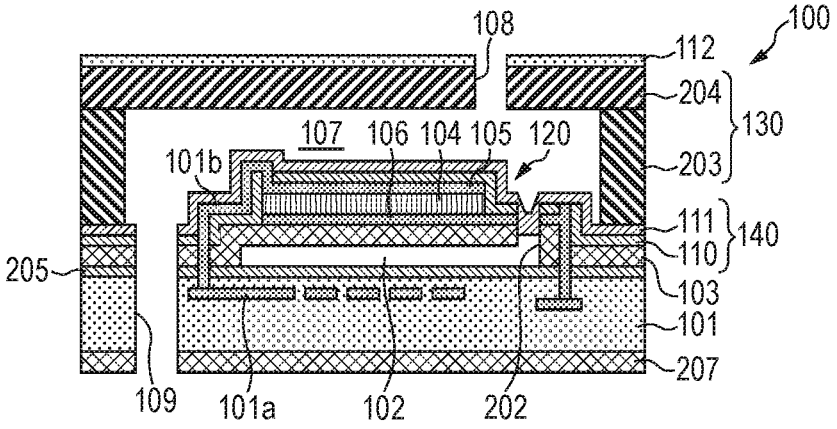
FIGS. 7A, 7B, and 7C are schematic cross-sectional views of liquid ejection heads pertaining to a third embodiment.
Figure 7B:
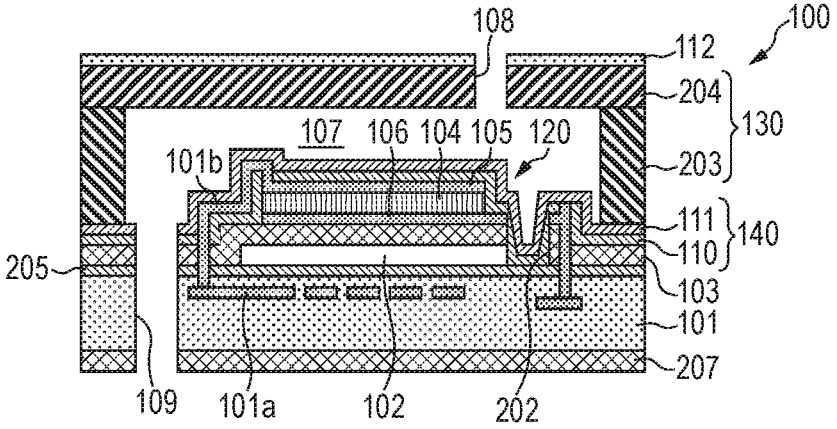
Figure 7C:
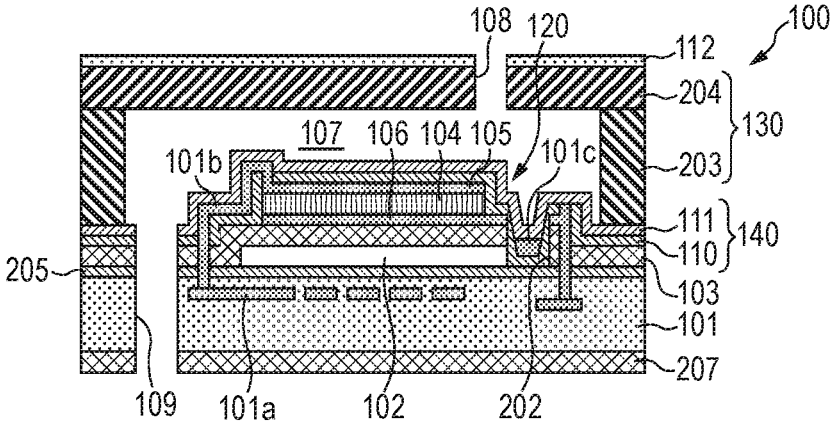
Figure 8A:
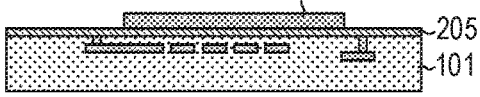
FIGS. 8A, 8B, 8C, 8D, 8E, 8F, 8G, 8H, 8I, 8J, 8K and 8L are schematic cross-sectional views showing a method for producing a liquid ejection head pertaining to the third embodiment.
Figure 8B:
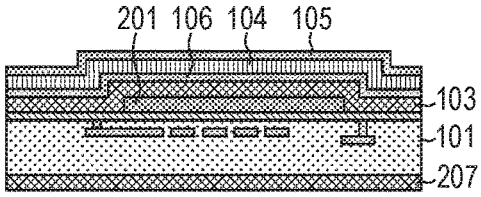
Figure 8C:
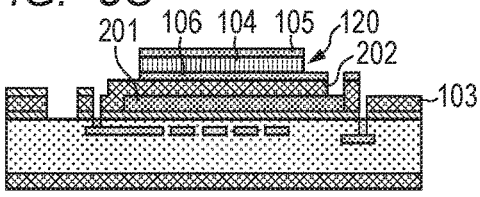
Figure 8D:
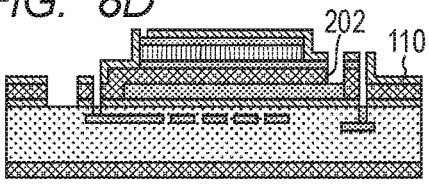
Figure 8E:
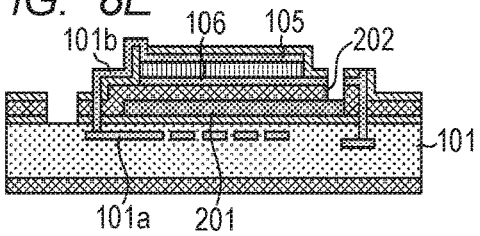
Figure 8F:
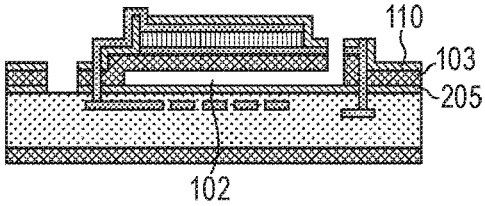
Figure 8G:
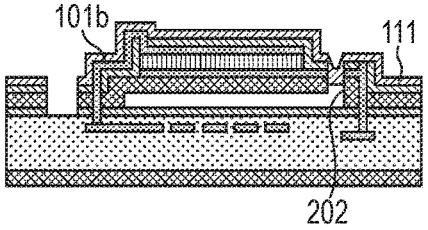
Figure 8H:
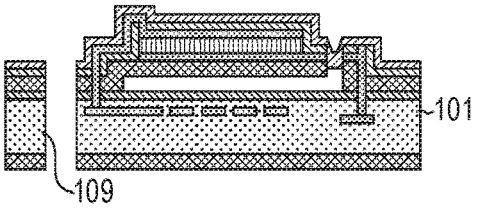
Figure 8I:
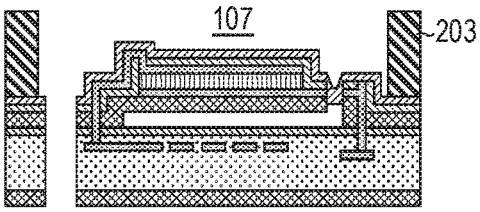
Figure 8J:
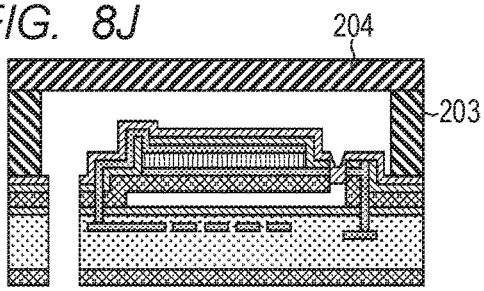
Figure 8K:
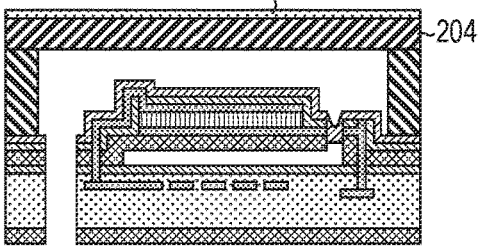
Figure 8L:
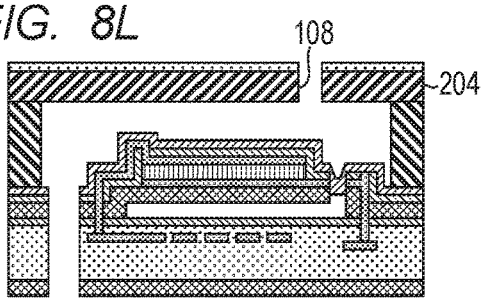

With reference to FIGS. 7A to 7C, the structure of a liquid ejection head pertaining to a third embodiment of the present disclosure will be described. FIG. 7A is a schematic cross-sectional view showing a liquid ejection head of the embodiment, and FIG. 7B and FIG. 7C are schematic cross-sectional views showing modified liquid ejection heads of the embodiment.

In the present embodiment, the structure of a communicating port 202 used as the etching hole for forming a space 102 is changed from the first and second embodiments. Specifically, a communicating port 202 is formed in the first thin film 103 not in the substrate 101. Accordingly, the structure for sealing (closing) the communicating port 202 also differs from the first and second embodiments. Specifically, the communicating port 202 is sealed by the second protective film 111 as shown in FIG. 7A. However, when the sealing is insufficient only by the second protective film 111 due to the relation of the aspect ratio of the communicating port 202, the height of the sacrificial layer 201, and the thickness of the second protective film 111, the first protective film 110 can also be used to seal the communicating port 202 as shown in FIG. 7B. In addition, a layer 101*c* made from the material of lead-out wirings 101*b* from the upper electrode 105 and the lower electrode 106 can also be used to seal the communicating port 202 as shown in FIG. 7C.

FIGS. 7A to 7C show cases in which the structure of the communicating port 202 is changed from the second embodiment in which the ejection orifice forming member 130 includes two members 203, 204, but it should be noted that a similar change can be made to the first embodiment.

With reference to FIGS. 8A to 8L, a method for producing a liquid ejection head of the embodiment will next be described. FIGS. 8A to 8L are schematic cross-sectional views of a liquid ejection head in respective steps of the production method of the embodiment. The following steps (8*a*) to (8*l*) correspond to FIG. 8A to FIG. 8L. Here, a production method of a liquid ejection head in which an etching hole (communicating port) 202 is sealed only by a second protective film 111 (see FIG. 7A) will be described.

(8*a*) The same substrate 101 as that prepared in step (3*a*) of the first embodiment is prepared, and a substrate protective film 205 is formed thereon. The same procedure as in step (3*b*) of the first embodiment is performed in the same conditions, forming a sacrificial layer 201. For the substrate protective film 205, a material having high etching selectivity to the sacrificial layer 201 is used to form a film. For example, for a sacrificial layer 201 made from Al as in the first combination described above, Si can be used as the substrate protective film 205, and $SiO_2$, SiN, or the like can also be used, or the substrate protective film 205 is not necessarily formed. However, when no substrate protective film 205 is formed, the material of lead-out wirings from the upper electrode 105 and the lower electrode 106 is required to be a material that is not dissolved in an Al wet etchant (Au, for example), or the surface of lead-out wirings is required to be protected before removal of the sacrificial layer 201. For a sacrificial layer made from $SiO_2$ as in the second combination described above, Si as well as SiN can be used as the substrate protective film 205, or the substrate protective film 205 is not necessarily formed. For a sacrificial layer made from Si as in the third combination described above, $SiO_2$, SiN, or the like is suitable for the substrate protective film 205.

(8*b*) The same procedure as in step (3*c*) of the first embodiment is performed in the same conditions, forming, on the substrate 101 and the sacrificial layer 201, a first thin film 103 functioning as a vibrating plate, a lower electrode 106, a piezoelectric body 104, and an upper electrode 105 in this order. In addition to the first thin film 103, a substrate protective film 207 made from the same material as the first thin film 103 is formed on the face opposite to the face on which the first thin film 103 is formed.

(8*c*) The same procedure as in step (3*d*) of the first embodiment is performed in the same conditions, patterning the upper electrode 105, the piezoelectric body 104, and the lower electrode 106 by photolithography to form a piezoelectric element 120.

Next, the first thin film 103 is patterned by photolithography to form through-holes for lead-out wirings from the upper electrode 105 and the lower electrode 106 and to form an etching hole (communicating port) 202. The patterning can be performed by dry etching. Here, the etching hole 202 is formed through the first thin film 103 so as to communicate with one end of the sacrificial layer 201 through an opening having a smaller area than the area of the top face of the sacrificial layer 201 (the region facing the first thin film 103). The appropriate opening size of the etching hole 202 is about 1 to 10 μm. When the opening size is small, a plurality of etching holes 202 are preferably provided in order to increase the etching rate for removing the sacrificial layer 201. The etching hole 202 is formed in such a position that a pattern of the lower electrode 106 can take a detour around the etching hole 202 to be connected to a connection of the lead-out wiring.

(8*d*) The same procedure as in step (3*f*) of the first embodiment is performed in the same conditions, forming a first protective film 110, which is patterned to form through-holes for lead-out wirings and to form a through-hole communicating with the etching hole 202.

(8*e*) The same procedure as in step (3*g*) of the first embodiment is performed in the same conditions, forming lead-out wirings 101*b* for connecting the upper electrode 105 and the lower electrode 106 to the wiring layer 101*a* on the substrate 101. In the step, a through-hole communicating with the etching hole 202 is formed by patterning.

(8*f*) The sacrificial layer 201 is removed by etching to form a space 102. A specific etching method is appropriately selected according to the material of the sacrificial layer 201 as described above. In an example, when the substrate protective film 205 is $SiO_2$, the first thin film 103 functioning as the vibrating plate is SiN, the first protective film 110 is $SiO_2$, and the sacrificial layer 201 is Si, dry etching with $XeF_2$ can be used.

(8*g*) The same procedure as in step (3*h*) of the first embodiment is performed in the same conditions, forming a second protective film 111 to protect the lead-out wirings 101*b* and to seal the etching hole 202. Patterning is also performed to form a through-hole communicating with a supply port 109 to be subsequently formed.

When the second protective film 111 is an oxide film by an ALD method, it is difficult to form a second protective film 111 having a sufficient thickness for sealing the etching hole 202, and thus another layer can be used in combination as a sealing layer for the etching hole 202. In other words, the first protective film 110 can be used in combination as shown in FIG. 7B, or the first protective film 110 and a layer formed from the material constituting the lead-out wirings 101*b* can be used in combination as shown in FIG. 7C. Such sealing can be achieved when the sacrificial layer 201 is removed after step (8*c*) and before step (8*d*) or step (8*e*). In such a case, the material of the sacrificial layer 201 and the etchant are required to be selected so as to achieve a sufficient etching selection ratio to the piezoelectric body 104, the upper electrode 105, and the lower electrode 106.

(8*h*) D-RIE is performed from a face of the substrate 101 opposite to the face above which the piezoelectric element 120 is formed, forming a supply port 109 in the substrate 101. The supply port 109 preferably has an opening size of about 60 to 120 μm (80 μm×120 μm for an ejection orifice 108 in an array shown in FIG. 2).

(8*i*) The same procedure as in step (6*a*) of the second embodiment is performed in the same conditions, forming a first member 203 having a pressure chamber 107.

(8*j*) The same procedure as in step (6*b*) of the second embodiment is performed in the same conditions, bonding the first member 203 to a second member 204 made from Si. The second member 204 is polished to an intended thickness.

(8*k*) The same procedure as in step (6*f*) of the second embodiment is performed in the same conditions, forming a water repellent film 112 on the second member 204.

(8*l*) The same procedure as in step (6*g*) of the second embodiment is performed in the same conditions, forming an ejection orifice 108 in the second member 204. Consequently, the liquid ejection head 100 shown in FIG. 7A is completed.

According to the present embodiment, the effect shown below can be achieved in addition to the effects achieved in the first and second embodiments. In other words, by providing the etching hole 202 in the first thin film 103, the whole region of the substrate 101 facing the sacrificial layer 201 can be efficiently used as a space for arranging wirings and integrated circuits, and ejection orifices 108 can be arranged at higher density. In addition, a reduction in rigidity of a substrate 101 by providing an etching hole 202 as a through-hole in the substrate 101 can be suppressed. An etching hole 202 formed in a substrate 101 is narrow and deep, thus an etchant for removing a sacrificial layer 201 is difficult to enter, and etching takes a long time. In contrast, the present embodiment has an advantage of being capable of reducing the etching time.

According to the present disclosure, a highly reliable liquid ejection head enabling arrangement of ejection orifices at high density and a method for producing the liquid ejection head can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-236613, filed Dec. 6, 2016, which is hereby incorporated by reference herein in its entirety.

What is claimed is:

1. A liquid ejection head comprising:

a substrate;

a piezoelectric element provided above the substrate;

an ejection orifice forming member provided above the substrate on a side on which the piezoelectric element is provided, the ejection orifice forming member having an ejection orifice configured to eject a liquid and defining a pressure chamber between the ejection orifice forming member and the substrate, the pressure chamber communicating with the ejection orifice and including the piezoelectric element therein;

a first thin film provided between the substrate and the piezoelectric element and defining a space between the first thin film and the substrate; and a second thin film provided on the piezoelectric element at a side opposite to the first thin film side and differing from the first thin film in rigidity, wherein a communicating port is formed in the substrate in a region facing the space, communicates with the space through an opening having a smaller area than an area of the region, and is closed at an end.

2. The liquid ejection head according to claim 1, wherein the end of the communicating port is closed by a closing layer provided on the substrate on a side opposite to the side on which the piezoelectric element is provided.

3. The liquid ejection head according to claim 1, further comprising:

a third thin film formed between the substrate and the space and protecting the substrate; and a fourth thin film formed on an inner wall of the communicating port and protecting the inner wall.

4. The liquid ejection head according to claim 1, wherein a wiring layer is formed in a region of the substrate, and the region faces the space.

5. The liquid ejection head according to claim 4, wherein the wiring layer includes an integrated circuit.

6. A liquid ejection head comprising:

a substrate;

a piezoelectric element provided above the substrate;

an ejection orifice forming member provided above the substrate on a side on which the piezoelectric element is provided, the ejection orifice forming member having an ejection orifice configured to eject a liquid and defining a pressure chamber between the ejection orifice forming member and the substrate, the pressure chamber communicating with the ejection orifice and including the piezoelectric element therein;

a first thin film provided between the substrate and the piezoelectric element and defining a space between the first thin film and the substrate; and a second thin film provided on the piezoelectric element on a side opposite to the first thin film side and differing from the first thin film in rigidity, wherein a communicating port is formed in the first thin film in a region facing the space, communicates with the space through an opening having a smaller area than an area of the region, and is closed in an inside or at an end.

7. The liquid ejection head according to claim 6, wherein the inside or the end of the communicating port is closed by a layer including the second thin film.

8. The liquid ejection head according to claim 7, wherein the layer includes a material that electrically connects the piezoelectric element to the substrate.

9. The liquid ejection head according to claim 6, further comprising a third thin film formed between the substrate and the space and protecting the substrate.

* * * * *